US007770267B2

(12) United States Patent
Chen et al.

(10) Patent No.: US 7,770,267 B2
(45) Date of Patent: Aug. 10, 2010

(54) BUCKLE

(75) Inventors: Shun-Min Chen, Taipei (TW); Jian-Qun Li, Taipei (TW)

(73) Assignee: Wonderland Nurserygoods Co., Ltd., Neihu, Taipei (TW)

( * ) Notice: Subject to any disclaimer, the term of this patent is extended or adjusted under 35 U.S.C. 154(b) by 73 days.

(21) Appl. No.: 11/754,377

(22) Filed: May 29, 2007

(65) Prior Publication Data

US 2008/0168634 A1 Jul. 17, 2008

Related U.S. Application Data

(60) Provisional application No. 60/885,397, filed on Jan. 17, 2007.

(51) Int. Cl.
*A44B 11/26* (2006.01)

(52) U.S. Cl. ..... 24/579.11; 24/632; 24/171; 24/615

(58) Field of Classification Search ..... 24/171, 24/196, 579.11, 631, 632, 614–616, 625
See application file for complete search history.

(56) References Cited

U.S. PATENT DOCUMENTS

| | | | | |
|---|---|---|---|---|
| 5,170,539 | A | 12/1992 | Lundstedt et al. | |
| 2005/0125970 | A1* | 6/2005 | Nolan | 24/615 |
| 2007/0137009 | A1* | 6/2007 | Chen | 24/630 |

FOREIGN PATENT DOCUMENTS

| | | | |
|---|---|---|---|
| GB | 2286851 | A * | 8/1995 |

* cited by examiner

*Primary Examiner*—James R Brittain
(74) *Attorney, Agent, or Firm*—Winston Hsu

(57) ABSTRACT

Two wedges extended from the first arm and the second arm of the waist-strap fastener respectively are utilized to engage with the waist-strap button. With inclined surfaces that face with each other on the first arm and the second arm, the mounting section of the waist-strap button is capable of squeezing through the gap between the first arm and the second arm. With the surfaces on the other side of the wedges respectively, the mounting section of the waist-strap button is securely held by the surfaces such that the waist-strap button is secured in the waist-strap fastener.

12 Claims, 7 Drawing Sheets

BUCKLE

CROSS REFERENCE TO RELATED APPLICATIONS

This application claims the benefit of U.S. Provisional Application No. 60/885,397, which was filed on Jan. 17, 2007 and is incorporated herein by reference.

BACKGROUND OF THE INVENTION

1. Field of the Invention

The present invention relates to a buckle, and more specifically, to a buckle having a strap-adjusting device.

2. Description of the Prior Art

In many baby car seats or strollers, buckle is often used to secure the child in the car seat or stroller. Generally, a prior art buckle is mainly assembled with a buckle body, shoulder straps, waist straps, and a crotch strap, with each strap fastened by fastener or hook on the buckle body.

Please refer to FIG. 1 and FIG. 2. A prior art waist-strap button 5 has a first arm 51 and a second arm 52, which two projectors 511 extend thereon respectively. As the waist-strap button 5 engages with the waist-strap fastener 4, the projectors 511 hold against a first arm 41 and a second arm 42 of the waist-strap fastener 4 respectively, as shown in section A circled in FIG. 1. The projectors 511 are for locking the waist-strap button 5 from detaching from the waist-strap fastener 4. A similar structure of the waist-strap fastener 4 and the waist-strap button 5 is disclosed in the U.S. Pat. No. 5,170,539. However, there are some limitations for the thickness of the first arm 41 and the second arm 42 of the waist-strap fastener 4. The first arm 41 and the second arm 42 of the waist-strap fastener 4 must be thin enough for saving overall manufacturing cost of the waist-strap fastener 4 and more importantly, for the waist-strap button 5 to properly engage. However, the waist-strap button 5 may be drew out from the waist-strap fastener 4 with force since the first arm 41 and the second arm 42 are more easily to crack if not thick enough and dangers happen.

SUMMARY OF THE INVENTION

The claimed invention provides a buckle. The buckle comprises a buckle body having two slots at two sides and a release button mounted on a top wall, a pair of waist-strap fasteners, and a pair of waist-strap buttons. Each of the waist-strap fasteners has a prong at one side and a first arm and a second arm at the other side. The waist-strap fastener is secured to the buckle body while the prong is inserted into the slot of the buckle body and is removed from the buckle body while the release button is pressed. Each of the waist-strap buttons has a mounting section wherein the first arm comprises a first wedge and the second arm comprises a second wedge to prevent the waist-strap button removing from the waist-strap fastener when the mounting section of the waist-strap button is coupled to the waist-strap fastener.

The claimed invention also provides a strap fastener. The strap fastener comprises a first arm having a first protrusion, a second arm having a second protrusion wherein a gap is formed between the first arm and the second arm, and a strap button having a mounting section configured for passing through the gap and coupling to the first protrusion and the second protrusion.

The claimed invention also provides a buckle. The buckle comprises a buckle body having two slots at two sides and a release button mounted on a top wall, a pair of shoulder-strap fasteners, a pair of waist-strap fasteners, and a pair of waist-strap buttons, each having a mounting section. Each of the waist-strap fasteners has a prong at one side and a first arm and a second arm at the other side. The waist-strap fastener and the shoulder-strap fastener are coupled together and the prong of the waist-strap fastener is inserted into the slot of the buckle body for securing the shoulder-strap fastener and the waist-strap fastener on the buckle body. The waist-strap fastener is removed from the buckle body while the release button is pressed. At least a protrusion is formed on one of the first arm and the second arm to prevent the waist-strap button removing from the waist-strap fastener when the mounting section of the waist-strap button is coupled to the waist-strap fastener.

These and other objectives of the present invention will no doubt become obvious to those of ordinary skill in the art after reading the following detailed description of the preferred embodiment that is illustrated in the various figures and drawings.

DETAILED DESCRIPTION

Figure 7:
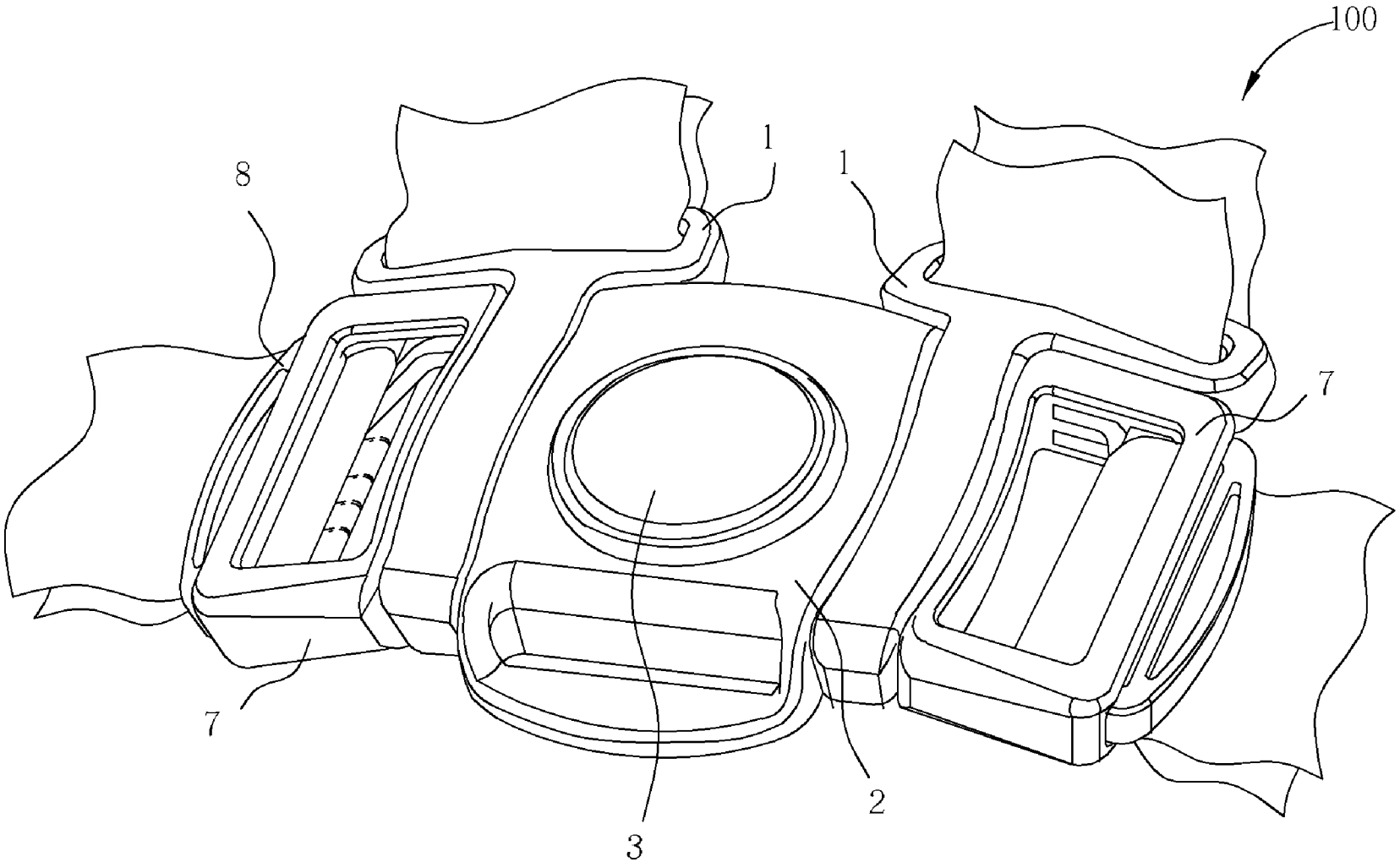
FIG. 7 is an illustration of the buckle according to an embodiment of the present invention.

FIG. 7 illustrates a buckle 100 according to an embodiment of the present invention. The buckle 100 in the present invention can be employed in adjustable harness systems designed to hold a child securely in a child product, such as a swing, a high chair, a bouncer, a car seat, or a stroller. It may also be used in any other context that requires an adjustable harness system. The buckle 100 comprises a pair of shoulder-strap fasteners 1, a buckle body 2 comprising two slots (not shown in the figure) at two sides and a release button 3 mounted on a top wall, a pair of waist-strap fasteners 7, and a pair of strap buttons 8. Separate straps pass through the shoulder-strap fasteners 1 and the waist-strap fasteners 7 of the buckle 100 and secure the child while the shoulder-strap fasteners 1 and the waist-strap fasteners 7 coupled to the buckle body 2. The strap connecting the waist-strap fastener 7 passes through between the waist-strap fastener 7 and the waist-strap button 8 while pressing the waist-strap button 8 can loose the strap so as to adjust the length of the strap. The buckle 100 according to an embodiment of the present invention secures the child in the seat with the straps by inserting the waist-strap fastener 7 through the shoulder-strap fastener 1 and snapping the waist-strap fastener 7 into the buckle body 2.

Figure 1:
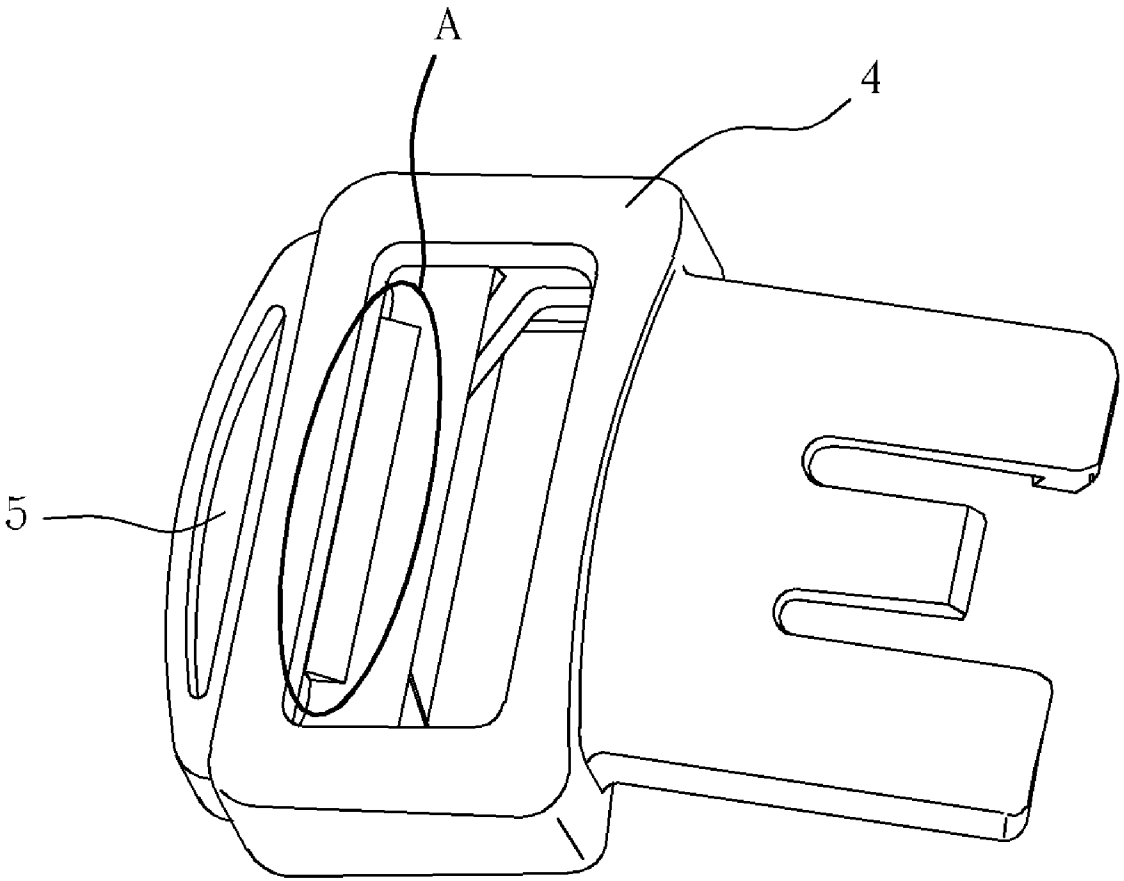
Fig. 1 Prior Art
FIG. 1 is an illustration of a waist-strap fastener with a waist-strap button engaged therein according to the prior art.
Figure 2:
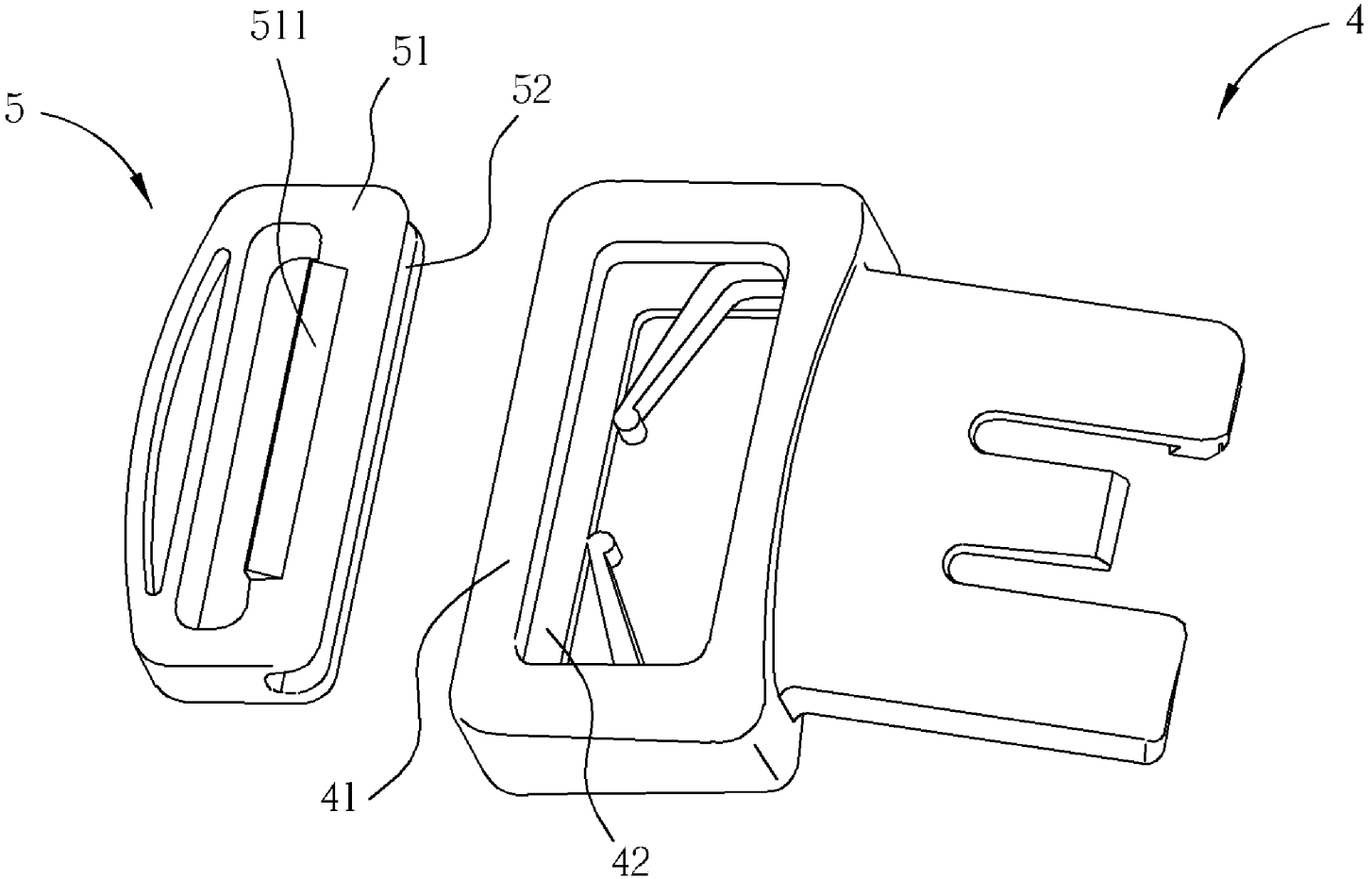
Fig. 2 Prior Art
FIG. 2 is an illustration of the waist-strap fastener and the waist-strap button in FIG. 1.
Figure 3:
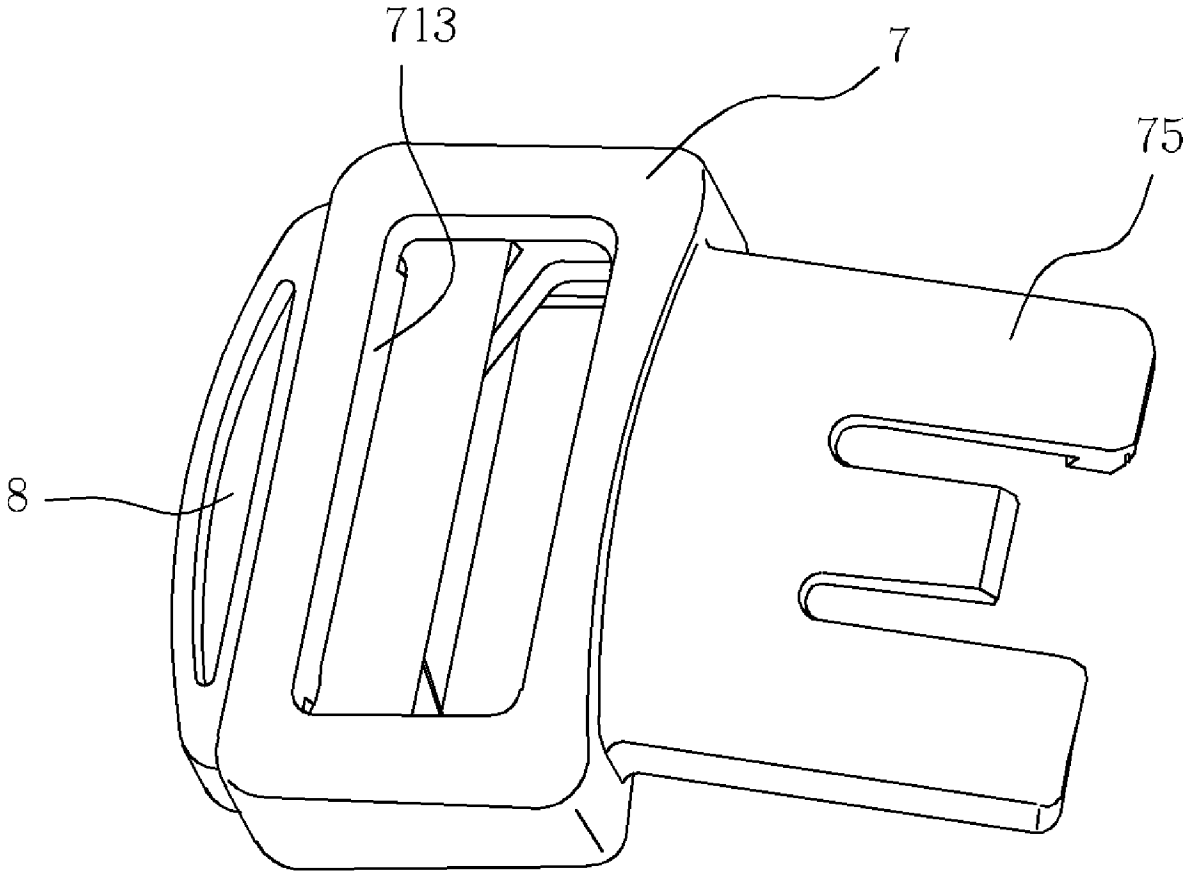
FIG. 3 is an illustration of a waist-strap fastener with a waist-strap button engaged therein according to an embodiment of the present invention.
Figure 4:
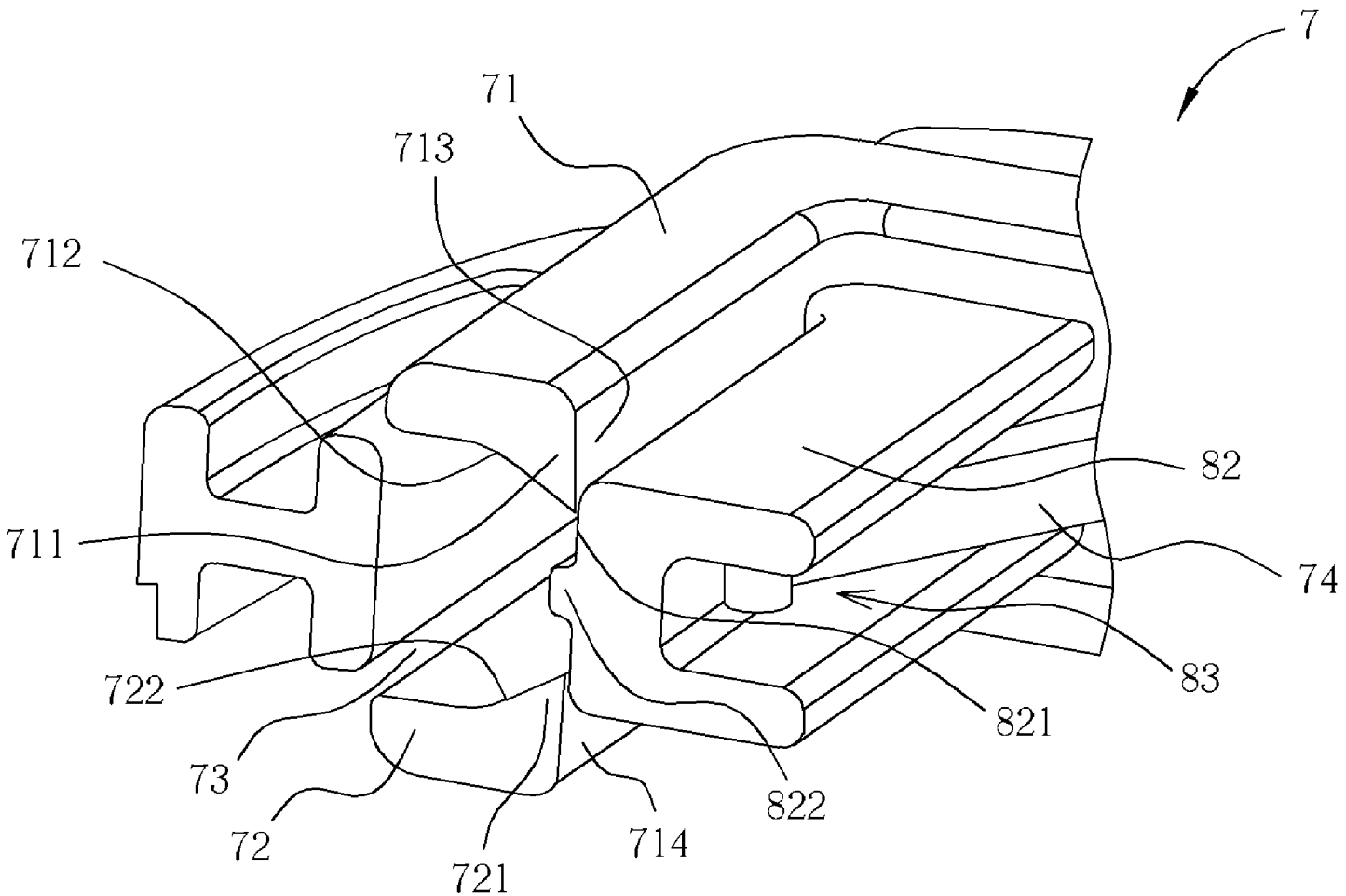
FIG. 4 is an illustration of the cross-section view of the waist-strap button engaging with the waist-strap fastener according to an embodiment of the present invention.
Figure 5:
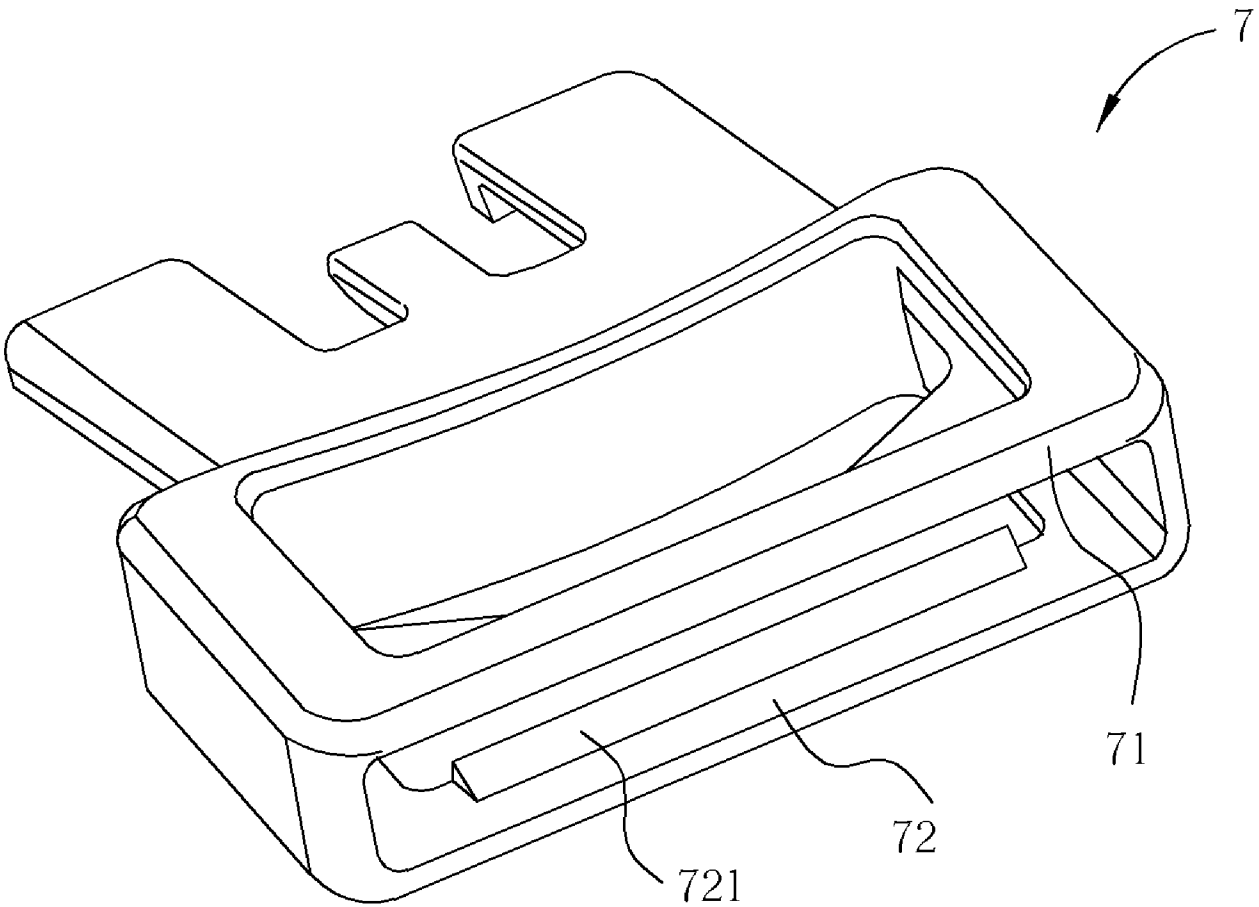
FIG. 5 is an illustration of the waist-strap fastener according to an embodiment of the present invention.

Please refer to FIG. 3 and FIG. 4. FIG. 3 is an illustration of the waist-strap fastener 7 with a waist-strap button 8 engaged therein according to an embodiment of the present invention. FIG. 4 is an illustration of the cross-section view. The waist-strap fastener 7 comprises a first arm 71 and a second arm 72 that are substantially parallel with each other. The waist-strap fastener 7 also comprises a prong 75 disposed at the opposite end of the first arm 71 and the second arm 72. The prong 75 is for inserting through a slot (not shown in the figure) of the shoulder-strap fastener 1 and the slot of the buckle body 2 and engaging with the buckle body 2 and the waist-strap fastener 7 is removed from the buckle 100 by pressing the release button 3 in the buckle body 2 for disengaging the prong 75 of the waist-strap fasteners 7 from the slot of the buckle body 2. Please also refer to FIG. 5 for an illustration of the individual waist-strap fastener 7 from another view angle and refer to FIG. 6 for an illustration of the individual waist-strap button 8 from another view angle. Between the first arm 71 and the second arm 72 of the waist-strap fastener 7 forms a gap 73. Two wedges 711, 721 extend from the first arm 71 and the second arm 72 into the gap 73 respectively and face with each other. In the exemplary embodiment, the two wedges 711,721 are triangular and the wedge 711 has an inclined surface 712 at one side of the wedge 711 facing the gap 73 and the first arm 71 further comprises a first surface 713 located at the other side of the wedge 711. The wedge 721 also has an inclined surface 722 at one side of the wedge 721 facing the gap 73 and the second arm 72 further comprises a second surface 714 located at the other side of the wedge 721.

Figure 6:
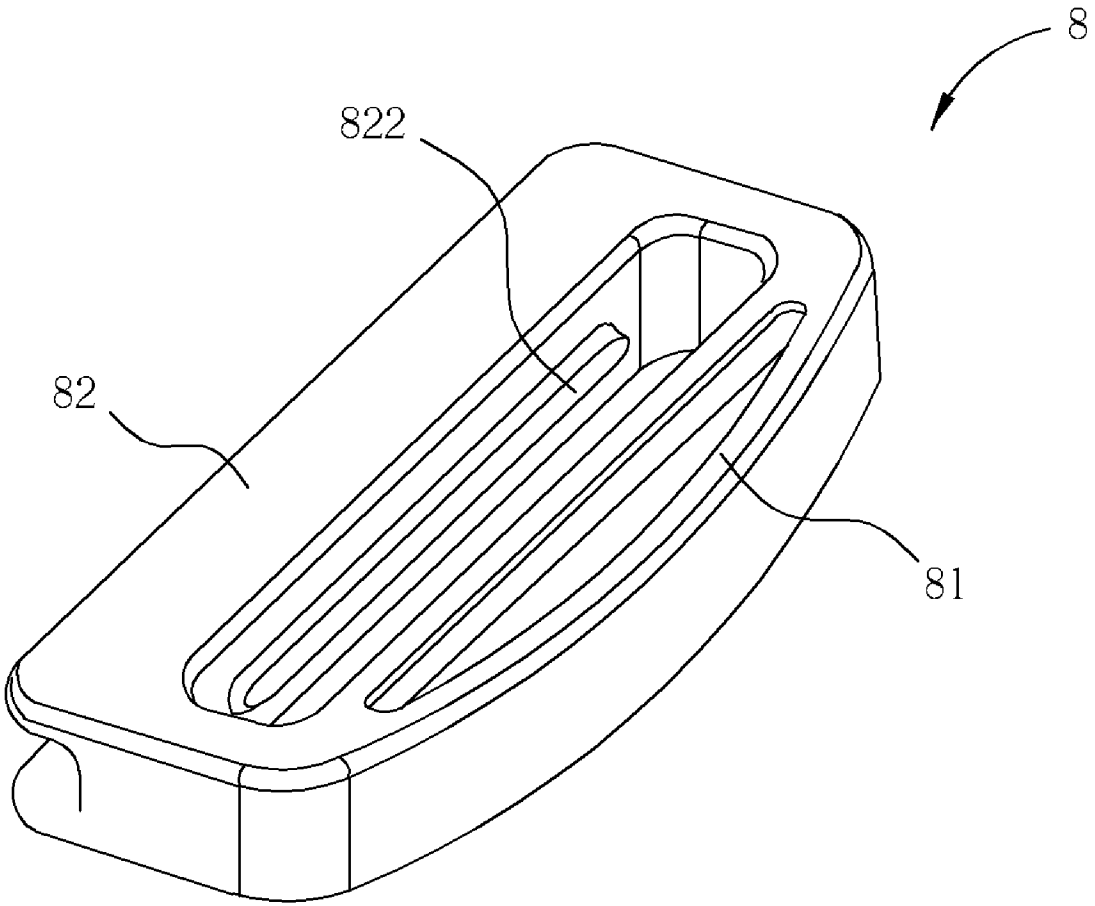
FIG. 6 is an illustration of the waist-strap button according to an embodiment of the present invention.

In FIG. 6, the waist-strap button 8 comprises a press section 81 and a mounting section 82 connecting to the press section 81. The press section 81 is protruding from the first arm 71 and the second arm 72 when the waist-strap button 8 is coupled to the waist-strap fastener 7. The mounting section 82 has a projection 822 raising from one surface that faces the press section 81 and a channel 83 at the other surface. The mounting section 82 is configured for engaging with the first arm 71 and the second arm 72 of the waist-strap fastener 7. On the surface of the mounting section 82 that faces the first arm 71 and the second arm 72 when the mounting section 82 is engaged with waist-strap fastener 7 locates a third surface 821 for holding against the first surface 713 and the second surface 714 and in the exemplary embodiment, the first surface 713, the second surface 714, and the third surface 821 are planes. For the waist-strap fastener assembly, a strap (not shown in the figure) wraps around the mounting section 82 and passes through between the first surface 713 of the first arm 71 and the third surface 821 of the mounting section 82 and passes through between the second surface 714 of the second arm 72 and the third surface 821 of the mounting section 82. A spring member 74 of the waist-strap fastener 7 extends from where near the prong 75 is located and extends to the gap 73 between the first arm 71 and the second arm 71. When the spring member 74 holds against the channel 83 of the waist-strap button 8, the strap is secured between the first arm 71 and the mounting section 82 and between the second arm 72 and the mounting section 82, the projection 822 on the third surface 821 is capable of holding against the strap for enhancing the securing of the strap.

When assembling the waist-strap fastener 7 with the waist-strap button 8, the mounting section 82 of the waist-strap button 8 is inserted by pressing the pressing section 81 through the gap 73 of the waist-strap fastener 7. The inclined surfaces 712, 722 of the first arm 71 and the second arm 72 allow the mounting section 82 to pass through until the third surface 821 of the mounting section 82 is abutted against the first surface 713 and the second surface 714. The spring member 74 then pushes the waist-strap button 8 and since the third surface 821 is held by the first surface 713 and the second surface 714, the waist-strap button 8 does not fall off from the waist-strap fastener 7. Since the waist-strap fastener assembly according to an embodiment of the present invention has wedges 711, 721 on the first arm 71 and the second arm 72 of the waist-strap fastener 7, which in other words, the "thickness" of the first arm 71 and the second arm 72 increases and the waist-strap fastener 7 is robust enough from cracking when the waist-strap button 8 may go through forced pulling. Additionally, the surface-to-surface contact between the waist-strap fastener 7 and the waist-strap button 8 ensures the fastening function required.

The present invention utilizes two wedges extended from the first arm and the second arm of the waist-strap fastener respectively to engage with the waist-strap button. With inclined surfaces that face with each other on the first arm and the second arm, the mounting section of the waist-strap button is capable of squeezing through the gap between the first arm and the second arm. With the surfaces on the other side of the wedges respectively, the mounting section of the waist-strap button is securely held by the surfaces such that the waist-strap button is secured in the waist-strap fastener.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A buckle, comprising:

a buckle body having two slots at two sides and a release button mounted on a top wall;

a pair of waist-strap fasteners, wherein one of the waist-strap fasteners comprises:

a prong at one side; and a first arm and a second arm at the other side, the waist-strap fastener being secured to the buckle body while the prong is inserted into one of the slots of the buckle body and removed from the buckle body while the release button is pressed;

a pair of waist-strap buttons, wherein one of the waist-strap buttons corresponding to the waist-strap fastener wherein comprises the prong at one side and the first arm and the second arm at the other side comprises a mounting section wherein the first arm comprises a first wedge and the second arm comprises a second wedge to prevent the waist-strap button removing from the waist-strap fastener when the mounting section of the waist-strap button is coupled to the waist-strap fastener, the waist-strap button comprising a projection extending from the mounting section; and a shoulder-strap fastener, wherein the prong at one side of the waist-strap fastener inserts through the shoulder-strap fastener and secures the shoulder-strap fastener on the buckle body.

2. The buckle of claim 1 wherein the first arm further comprises a first surface, the second arm further comprises a second surface, and the waist-strap button further comprises a third surface on the mounting section for holding against the first surface and the second surface.

3. The buckle of claim 2, further comprising a strap passing through between the first surface, the second surface, and the third surface, and held against by the projection.

4. The buckle of claim 1 wherein the waist-strap button further comprises a press section connecting to the mounting section.

5. The buckle of claim 1 wherein the waist-strap fastener further comprises a gap locating between the first arm and the second arm for allowing the mounting section of the waist-strap button to pass through, the first wedge and the second wedge extending from the first arm and the second arm into the gap respectively.

6. The buckle of claim 1 wherein the first wedge and the second wedge further comprise an inclined surface respectively.

7. The buckle of claim 1 wherein the first wedge of the first arm and the second wedge of the second arm are configured to face with each other.

8. The buckle of claim 1 wherein the waist-strap button further comprises a channel on the mounting section and the waist-strap fastener further comprises a spring member for holding against the channel.

9. A buckle, comprising:

a buckle body having two slots at two sides and a release button mounted on a top wall;

a pair of shoulder-strap fasteners, wherein one of the shoulder-strap fasteners comprises a ring;

a pair of waist-strap fasteners, wherein one of the waist-strap fasteners corresponding to the shoulder-strap fastener wherein comprises the ring comprises a prong at one side and a first arm and a second arm at the other side, the waist-strap fastener and the corresponding shoulder-strap fastener being coupled together and the prong of the waist-strap fastener passing through the ring and inserted into one of the slots of the buckle body for securing the shoulder-strap fastener and the corresponding waist-strap fastener on the buckle body, the waist-strap fastener being removed from the buckle body while the release button is pressed; and a pair of waist-strap buttons, wherein one of the waist-strap buttons corresponding to the waist-strap fastener wherein comprises the prong at one side and the first arm and the second arm at the other side comprises a mounting section, the waist-strap button comprising a projection extending from the mounting section;

wherein at least a protrusion is formed on one of the first arm and the second arm to prevent the waist-strap button removing from the corresponding waist-strap fastener when the mounting section of the waist-strap button is coupled to the waist-strap fastener.

10. The buckle of claim 9 wherein the protrusion of one of the first arm and the second arm is triangular and has an inclined surface and a first surface, the mounting section of the waist-strap button further comprising a second surface corresponding to the first surface for being abutted against the first surface when the waist-strap button is coupled to the waist-strap fastener.

11. A buckle, comprising:

a buckle body having two slots at two sides and a release button mounted on a top wall;

a pair of waist-strap fasteners, wherein one of the waist-strap fasteners comprises:

a prong at one side; and a first arm and a second arm at the other side, the waist-strap fastener being secured to the buckle body while the prong is inserted into one of the slots of the buckle body and removed from the buckle body while the release button is pressed; and a pair of waist-strap buttons, wherein one of the waist-strap buttons corresponding to the waist-strap fastener, which comprises the prong at one side and the first arm and the second arm at the other side, comprises a mounting section wherein the first arm comprises a first wedge and the second arm comprises a second wedge to prevent the waist-strap button removing from the waist-strap fastener when the mounting section of the waist-strap button is coupled to the waist-strap fastener, the waist-strap button comprising a projection extending from the mounting section.

12. The buckle of claim 11 wherein the first arm further comprises a first surface, the second arm further comprises a second surface, and the waist-strap button further comprises a third surface on the mounting section for holding against the first surface and the second surface.

* * * * *